US007494381B1

(12) United States Patent
Wu et al.

(10) Patent No.: US 7,494,381 B1
(45) Date of Patent: Feb. 24, 2009

(54) SIM CARD CONNECTOR

(75) Inventors: Yin-lung Wu, Tu-Cheng (TW); Ming-chiang Chen, Tu-Cheng (TW); Min Song, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/987,682

(22) Filed: Dec. 4, 2007

(51) Int. Cl.
*H01R 24/00* (2006.01)

(52) U.S. Cl. ..... 439/630; 439/862

(58) Field of Classification Search ..... 439/630, 439/862

See application file for complete search history.

(56) References Cited

U.S. PATENT DOCUMENTS 5,823,828 A * 10/1998 Bricaud et al. ..... 439/630
6,283,376 B1 * 9/2001 Schuder et al. ..... 235/486
6,796,842 B1 * 9/2004 Wang ..... 439/630
2005/0130510 A1 * 6/2005 Zheng et al. ..... 439/862
2005/0159037 A1 * 7/2005 Su et al. ..... 439/326

* cited by examiner

*Primary Examiner*—Tho D Ta
(74) *Attorney, Agent, or Firm*—Rosenberg, Klein & Lee

(57) ABSTRACT

A SIM card connector for connecting a SIM card with a printed circuit board of an electronic device includes a housing and a connector body. The housing has a lower portion adapted to be removably mounted on and cover the printed circuit board and an upper portion defining a receiving room for receiving the SIM card. The connector body mounted in the housing includes an insulating panel and terminals. Each of the terminals has a basic portion held in the insulating panel. A part of the basic portion tilts upward and extends into the receiving room of the housing to form a first contact portion for making contact with the SIM card. Another part of the basic portion tilts downward and extends below the lower portion of the housing to form a second contact portion for elastically touching the printed circuit board.

20 Claims, 4 Drawing Sheets

SIM CARD CONNECTOR

BACKGROUND OF THE INVENTION

1. Field of the Invention

The present invention relates to a subscriber identity module (SIM) card connector, and more particularly to a SIM card connector of which terminals are easily disassembled from a printed circuit board (PCB) of an electronic device if the terminals of the SIM card connector are destroyed or become loose.

2. The Related Art

As we know that a subscriber identity module (SIM) card is a portable memory chip used in some models of electronic devices, such as cellular telephones. The SIM card holds personal identity information, phone numbers, phone books, text messages and other data. The SIM card includes a terminal module to connect with a SIM card connector assembled in the electronic device for communicating with the electronic device. Generally, the SIM card connector includes a receiving cavity to receive the SIM card and a plurality of terminals mounted on an insulating housing of the SIM card connector to couple with the terminal module of the SIM card. While the SIM card is inserted into the receiving cavity of the SIM card connector, the terminals of the SIM card connector communicate with the terminal module of the SIM card to achieve the communication between the SIM card connector and the SIM card.

On one hand, the SIM card connector communicates with the SIM card received therein, and on the other hand, the terminals of the SIM card connector are conventionally soldered on a printed circuit board (PCB) of the electronic device for connecting the SIM card with the electronic device. However, the terminals of the SIM card connector are liable to become loose or be destroyed when the SIM card connector suffers collisions or the SIM card is repeatedly inserted into or withdrawn from the SIM card connector, and what is badly, the terminals of the SIM card connector are prone to unsoldering from the PCB of the electronic device, which causes the communication between the SIM card and the electronic device to be broken off. Then, if the terminals of the SIM card connector are destroyed, the terminals need disassembling from the PCB of the electronic device. Because the terminals of the SIM card connector are soldered to the PCB, the difficulty of disassembly is increased, and even more, the PCB is easily damaged in the process of disassembling the terminals of the SIM card connector from the PCB.

SUMMARY OF THE INVENTION

Accordingly, an object of the present invention is to provide a SIM card connector of which terminals are easily disassembled from a printed circuit board of an electronic device.

To achieve the object, the SIM card connector includes a housing and a connector body. The housing has a lower portion adapted to be removably mounted on and cover the printed circuit board and an upper portion defining a receiving room for receiving the SIM card. The connector body mounted in the housing includes an insulating panel and terminals. Each of the terminals has a basic portion held in the insulating panel. A part of the basic portion tilts upward and extends into the receiving room of the housing to form a first contact portion for making contact with the SIM card. Another part of the basic portion tilts downward and extends below the lower portion of the housing to form a second contact portion for elastically touching the printed circuit board.

As described above, the housing of the SIM card connector is capable of being removed from the printed circuit board, and the second contact portions of the terminals elastically touch the printed circuit board respectively so that the terminals can be easily disassembled from the printed circuit board when the terminals of the connector body of the SIM card connector are destroyed or become loose, which prevent the printed circuit board from being damaged in the process of disassembling the terminals of the SIM card connector from the printed circuit board.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
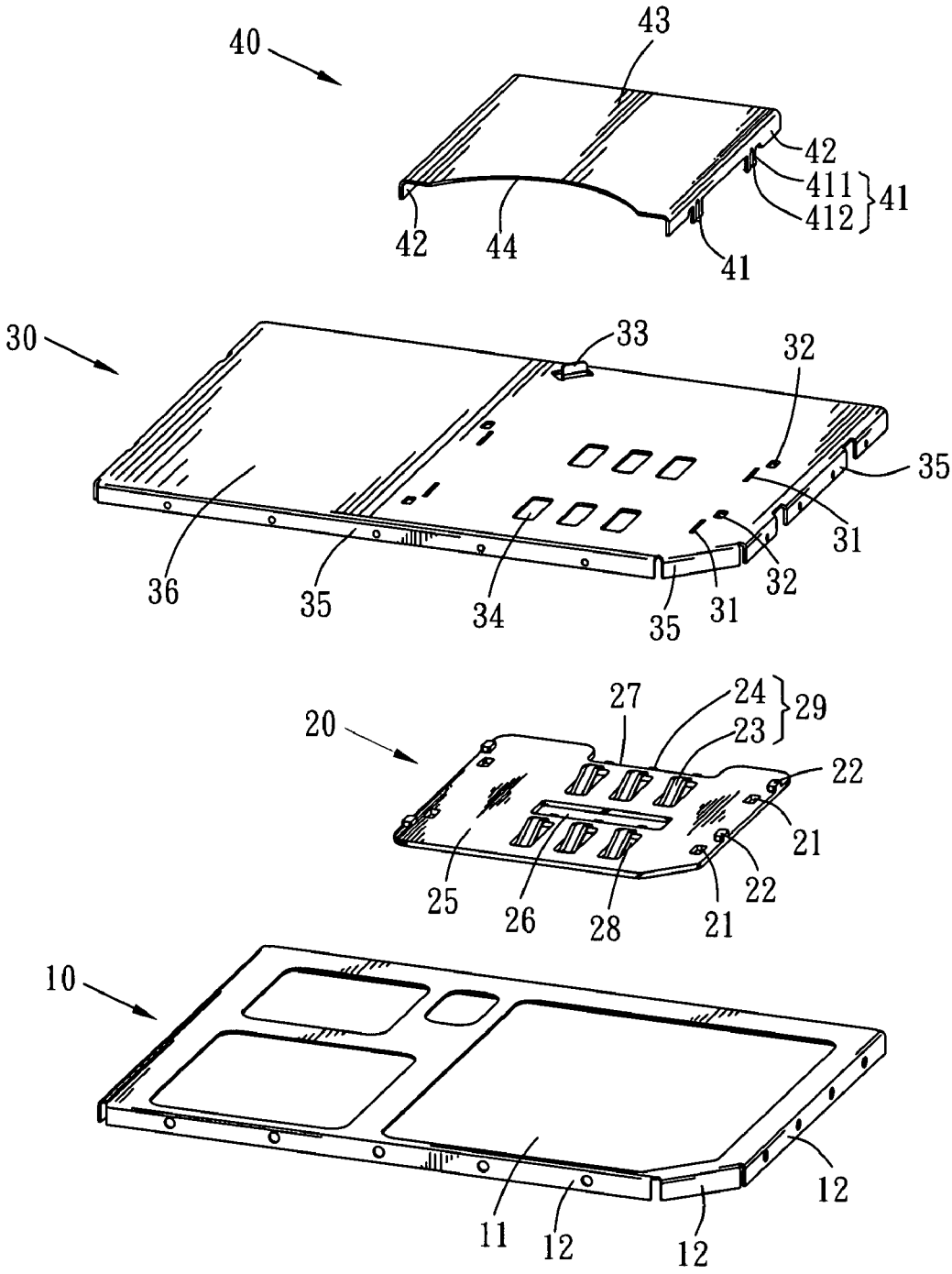
FIG. 1 is an exploded view of a SIM card connector of the present invention.

Referring to FIG. 1, showing a preferred embodiment of a subscriber identity module (SIM) card connector of the present invention for connecting a SIM card with an electronic device (not shown), the SIM card connector assembled in the electronic device includes a lower shell 10 located on a printed circuit board (PCB) of the electronic device, an upper shell 30 mating with the lower shell 10, a connector body 20 disposed in the upper shell 30 and received in the lower shell 10 and a metallic cover 40 mounted on the top of the upper shell 30 and covering the connector body 20.

Please continually refer to FIG. 1. The lower shell 10 is board-shaped and defines a substantially rectangular accommodating hole 11 passing therethrough. The lower shell 10 extends downward at edges thereof to form fences 12 located on the PCB of the electronic device.

Figure 5:
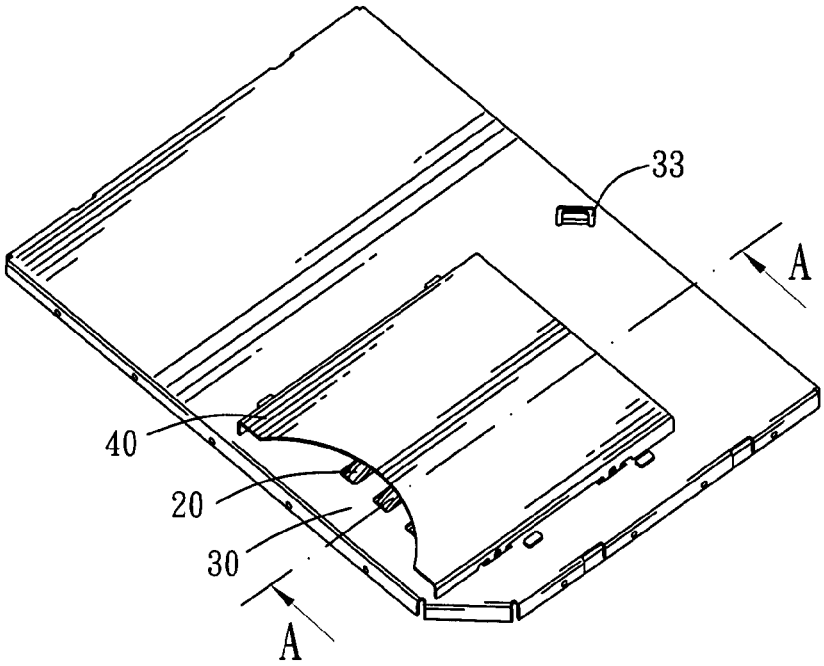
FIG. 5 is an assembly view of the SIM card connector.

With reference to FIG. 1 and FIG. 5, the upper shell 30 has a board-shaped top board 36. The top board 36 extends downward at edges thereof to form enclosures 35 buckling with the fences 12 of the lower shell 10 in order to locate the upper shell 30 on the top of the lower shell 10. The top board 36 longitudinally defines six through-holes 34 passing therethrough at a side thereof. Four accommodating apertures 32 and four locating slots 31 adjacent to the accommodating apertures 32 are defined at the front and rear of the top board 36 and every two accommodating apertures 32 and every two locating slots 31 are symmetrically arranged at opposite sides of the through-holes 34. The top of the top board 36 protrudes upward at rear of the through-holes 34 and near a rear edge thereof to form a limiting block 33.

Figure 2:
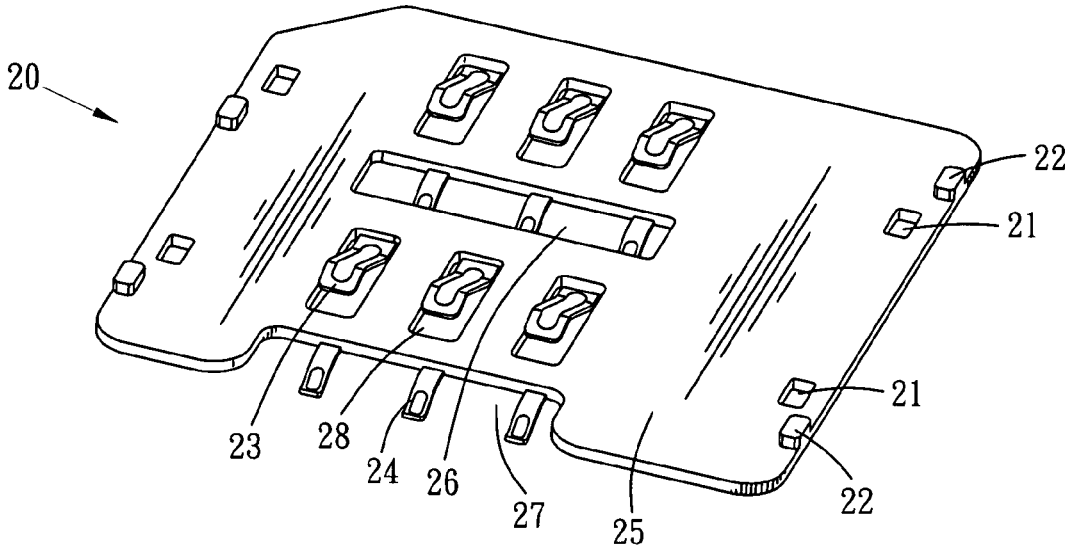
FIG. 2 is a perspective view of a connector body of the SIM card connector.
Figure 3:
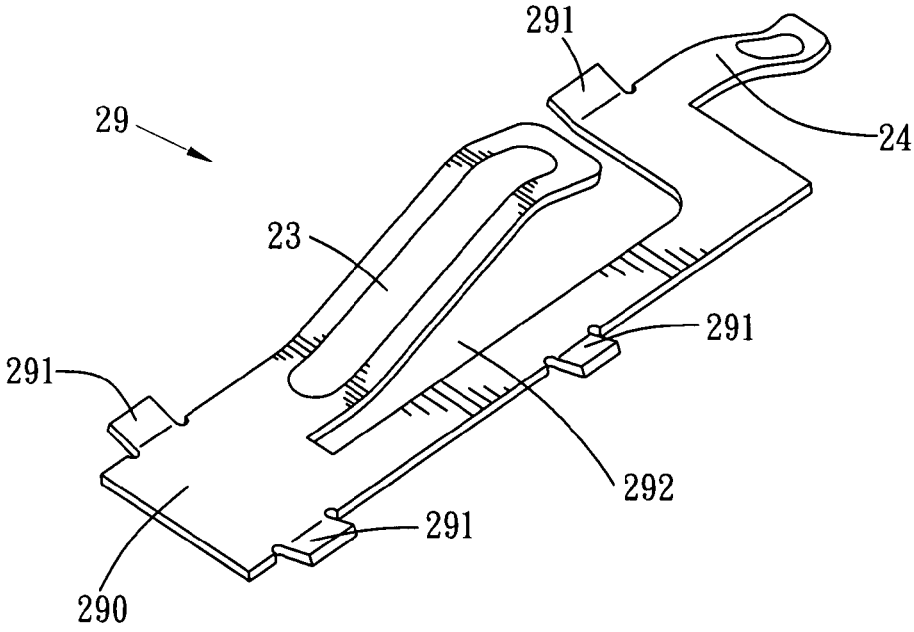
FIG. 3 is a perspective view of a terminal of the SIM card connector.
Figure 4:
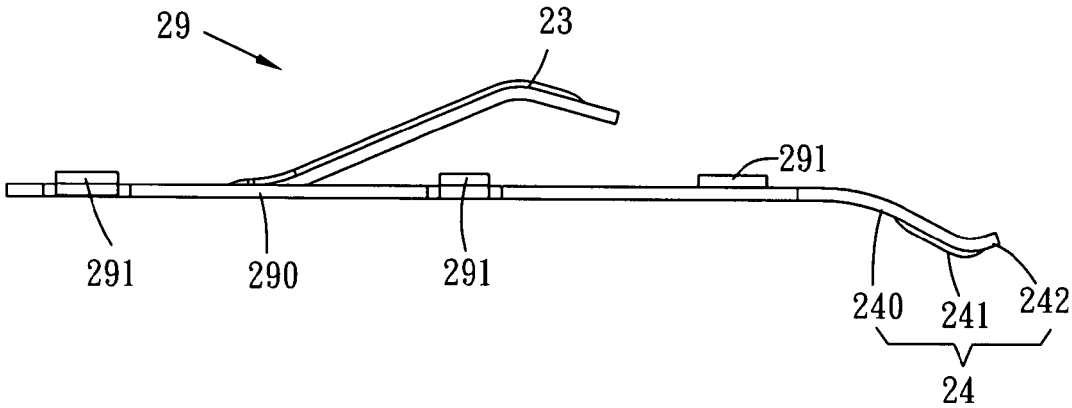
FIG. 4 is a side view of the terminal.

Referring to FIG. 1 and FIG. 2, the connector body 20 includes a flat insulating panel 25 and a plurality of terminals 29. The insulating panel 25 is of plastic and substantially rectangular. Opposite sides of the top of the insulating panel 25 protrude upward to form four bumps 22 that are inserted in the four accommodating apertures 32 of the upper shell 30 for mounting the insulating panel 25 against the bottom of the top board 36 of the upper shell 30. Four fixing holes 21 are defined on the opposite sides of the insulating panel 25 and adjacent to the four bumps 22 respectively. The insulating panel 25 transversely defines an oblong receiving cavity 26 passing therethrough at substantial center. The rear of the insulating panel 25 transversely defines a receiving opening 27 parallel with the receiving cavity 26 and communicating with outside. Six terminal grooves 28 are longitudinally defined at substantial centers of the front and rear of the insulating panel 25. Three of the terminal grooves 28 are arranged in a transverse row in front of the receiving cavity 26. The other three terminal grooves 28 are arranged in a transverse row in rear of the receiving cavity 26 and in front of the receiving opening 27.

Please refer to FIG. 2, FIG. 3, FIG. 4 and FIG. 6. In the preferred embodiment of the present invention, the terminals 29 are integrally formed with the insulating panel 25 to form the connecting body 20, which ensures that the terminals 29 are firmly assembled in the insulating panel 25. The terminal 29 has a basic portion 290 in rectangular sheet-shape and disposed longitudinally. The center of the side of the basic portion 290 defines a rectangular hollow gap 292 extending toward the inner of the basic portion 290. The front of the basic portion 290 extends rearward to form a first contact portion 23 tilting upward and bending downward a bit at a free end thereof. The first contact portion 23 is above the hollow gap 292. The rear of the basic portion 290 extends rearward to form a second contact portion 24 at the same side as the first contact portion 23. The second contact portion 24 has an elastic portion 240 extending rearward from the rear of the basic portion 290 and inclining downward. A rear end of the elastic portion 240 tilts upward a bit to form a rear portion 242. The bottom of the junction of the elastic portion 240 and the rear portion 242 protrudes downward to form a contact point 241. Opposite sides of the basic portion 290 protrude outward to form four fixing tabs 291 tilting upward a bit. The basic portion 290 and the fixing tabs 291 are integrally formed with the insulating panel 25. The first contact portion 23 protrudes out from the terminal groove 28 of the insulating panel 25 and the corresponding through-hole 34 of the upper shell 30 for contacting the SIM card accepted in the SIM card connector (not shown) to achieve the signal communication between the SIM card connector and the SIM card. The second contact portion 24 passes through the insulating panel 25 and stretches into the receiving cavity 26 or the receiving opening 27 of the insulating panel 25.

Figure 6:
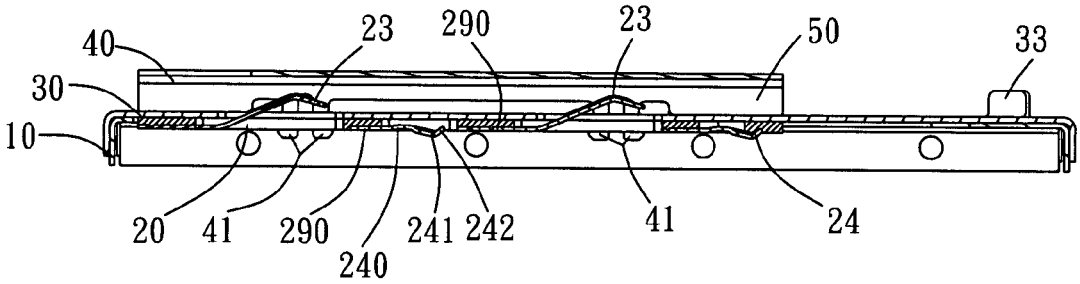
FIG. 6 is a cross-sectional view of the SIM card connector taken substantially along line A-A of FIG. 5.

Please refer to FIG. 1, FIG. 5 and FIG. 6. The metallic cover 40 has a top section 43 and two side sections 42 bending downward from opposite sides of the top section 43. The front of the metallic cover 40 defines an inserting mouth 44 from which the SIM card is inserted into the SIM card connector. The bottom of the side section 42 extends downward to form two locking portions 41. The locking portion 41 includes a pair of resilient arms 411 adjacent and parallel with each other. Each of the resilient arms 411 protrudes outward to form a hook 412 thereon. The pair of the resilient arms 411 is inserted in the locating slot 31 of the upper shell 30 and further inserted in the fixing hole 21 of the insulating panel 25 and the hooks 412 clasp the bottom of the insulating panel 25 for integrating the connector body 20, the upper shell 30 and the metallic cover 40 together. The top section 43, the two side sections 42 and the top board 36 of the upper shell 30 define a receiving room 50 for receiving the SIM card. The receiving room 50 receives the first contact portions 23 of the terminals 29 of the connector body 20.

With reference to FIG. 5 and FIG. 6, while the SIM card connector is assembled, the combination of the connector body 20, the upper shell 30 and the metallic cover 40 is engaged with the lower shell 10. The connector body 20 is tightly mounted in the accommodating hole 11 of the lower shell 10. Then the contact points 241 of the second contact portions 24 of the terminals 29 are pressed to elastically touch the PCB for electrical connection between the SIM card connector and the PCB. When the SIM card is inserted into the receiving room 50 from the inserting mouth 44 of the metallic cover 40, the first contact portions 23 of the terminals 29 contact the SIM card for connecting the SIM card with the PCB. The limiting block 33 defined on the upper shell 30 is used for limiting the inserting deepness of the SIM card.

As described above, the connector body 20 and the metallic cover 40 are assembled with the upper shell 30 and the lower shell 10 to define the SIM card connector, which reduces the space that the SIM card connector occupies in the electronic device. Besides, because the receiving room 50 is defined by the top section 43 and the two side sections 42 of the metallic cover 40 and the top board 36 of the upper shell 30, when the SIM card is inserted in the receiving room 50, the SIM card is shielded very well, avoiding the electromagnetic interference from the outside.

Because the terminals 29 are respectively integrally formed with the insulating panel 25, the terminals 29 are assembled in the insulating panel 25 much more firmly, and what is more, the second contact portions 24 of the terminals 29 of the SIM card connector elastically touch the PCB respectively, which ensure the stable communication between the SIM card and the PCB. Besides, when the terminals 29 are destroyed and need disassembling from the PCB, firstly the metallic cover 40 is separated apart from the upper shell 30 and the connector body 20, and then the upper shell 30 is disassembled from the lower shell 10. Then the connector body 20 is removed from the accommodating hole 11 of the lower shell 10. Therefore, the terminals 29 are easily separated apart from the PCB because the second contact portions 24 of the terminals 29 elastically touch the PCB respectively, which prevents the PCB from being damaged in the process of disassembling the terminals 29 of the connector body 20 from the PCB.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A SIM card connector for connecting a SIM card with a printed circuit board of an electronic device, comprising:

a housing having a lower portion adapted to be removably mounted on and cover the printed circuit board and an upper portion defining a receiving room for receiving the SIM card; and a connector body mounted in the housing, the connector body including an insulating panel and terminals, each of the terminals having a basic portion held in the insulating panel, a part of the basic portion tilting upward and extending into the receiving room of the housing to form a first contact portion for making contact with the SIM card, another part of the basic portion tilting downward and extending below the lower portion of the housing to form a second contact portion for elastically touching the printed circuit board, the insulating panel defines terminal grooves for receiving the terminals, a receiving cavity between the terminal grooves, and a receiving opening parallel with the receiving cavity and communicating with outside, the terminal grooves are divided into two groups, one group of the terminal grooves is disposed in front of the receiving cavity, and the other group of the terminal grooves is disposed in rear of the receiving cavity and in front of the receiving opening.

2. The SIM card connector as claimed in claim 1, wherein the second contact portion has an elastic portion extending from the basic portion and inclining downward, a free end of the elastic portion tilts upward a bit to form a rear portion, the bottom of the junction of the elastic portion and the rear portion protrudes downward to form a contact point.

3. The SIM card connector as claimed in claim 1, wherein the housing includes a shell and a cover mounted on the shell, the shell has a top board, the insulating panel is fixed beneath the top board of the shell, the receiving room is formed between the cover and the shell.

4. The SIM card connector as claimed in claim 3, wherein the top board of the shell defines locating slots at opposite sides thereof, opposite sides of the insulating panel define fixing holes, the cover has a top section and two side sections bending downward from opposite sides of the top section, each side section extends downward to form locking portions inserted in the locating slots of the shell and further inserted in the fixing holes of the insulating panel.

5. The SIM card connector as claimed in claim 4, wherein the locking portion has a pair of resilient arm adjacent and parallel with each other, the resilient arm protrudes outward to form a hook, the pair of the resilient arms is inserted in the locating slot of the shell and further inserted in the fixing hole of the insulating panel, the hooks clasp the bottom of the insulating panel.

6. The SIM card connector as claimed in claim 3, wherein the shell has an upper shell and a lower shell combined with each other, the top board is defined by the upper shell, the lower shell defines an accommodating hole for allowing the second contact portions of the terminals to pass therethrough to touch the printed circuit board.

7. The SIM card connector as claimed in claim 6, wherein the lower shell extends downward at edges thereof to form fences located on the printed circuit board, the top board of the upper shell extends downward at edges thereof to form enclosures buckling with the fences of the lower shell to locate the upper shell on the top of the lower shell.

8. A SIM card connector for connecting a SIM card with a printed circuit board of an electronic device, comprising:

a housing having a lower portion adapted to be removably mounted on and cover the printed circuit board and an upper portion defining a receiving room for receiving the SIM card; and a connector body mounted in the housing, the connector body including an insulating panel and terminals, each of the terminals having a basic portion held in the insulating panel, a part of the basic portion tilting upward and extending into the receiving room of the housing to form a first contact portion for making contact with the SIM card, another part of the basic portion tilting downward and extending below the lower portion of the housing to form a second contact portion for elastically touching the printed circuit board;

wherein the second contact portion has an elastic portion extending from the basic portion and inclining downward, a free end of the elastic portion tilts upward a bit to form a rear portion, a bottom of a junction of the elastic portion and the rear portion protrudes downward to form a contact point.

9. The SIM card connector as claimed in claim 8, wherein the housing includes a shell and a cover mounted on the shell, the shell has a top board, the insulating panel is fixed beneath the top board of the shell, the receiving room is formed between the cover and the shell.

10. The SIM card connector as claimed in claim 9, wherein the top board of the shell defines locating slots at opposite sides thereof, opposite sides of the insulating panel define fixing holes, the cover has a top section and two side sections bending downward from opposite sides of the top section, each side section extends downward to form locking portions inserted in the locating slots of the shell and further inserted in the fixing holes of the insulating panel.

11. The SIM card connector as claimed in claim 10, wherein the locking portion has a pair of resilient arm adjacent and parallel with each other, the resilient arm protrudes outward to form a hook, the pair of the resilient arms is inserted in the locating slot of the shell and further inserted in the fixing hole of the insulating panel, the hooks clasp the bottom of the insulating panel.

12. The SIM card connector as claimed in claim 9, wherein the shell has an upper shell and a lower shell combined with each other, the top board is defined by the upper shell, the lower shell defines an accommodating hole for allowing the second contact portions of the terminals to pass therethrough to touch the printed circuit board.

13. The SIM card connector as claimed in claim 12, wherein the lower shell extends downward at edges thereof to form fences located on the printed circuit board, the top board of the upper shell extends downward at edges thereof to form enclosures buckling with the fences of the lower shell to locate the upper shell on the top of the lower shell.

14. A SIM card connector for connecting a SIM card with a printed circuit board of an electronic device, comprising:

a housing having a lower portion adapted to be removably mounted on and cover the printed circuit board and an upper portion defining a receiving room for receiving the SIM card, the housing includes a shell and a cover mounted on the shell, the shell has a top board and the receiving room is formed between the cover and the shell; and a connector body mounted in the housing, the connector body including an insulating panel and terminals, the insulating panel being fixed beneath the top board of the shell, each of the terminals having a basic portion held in the insulating panel, a part of the basic portion tilting upward and extending into the receiving room of the housing to form a first contact portion for making contact with the SIM card, another part of the basic portion tilting downward and extending below the lower portion of the housing to form a second contact portion for elastically touching the printed circuit board.

15. The SIM card connector as claimed in claim 14, wherein the top board of the shell defines accommodating apertures, edges of the insulating panel protrude upward to form bumps respectively inserted in the accommodating apertures for mounting the insulating panel.

16. The SIM card connector as claimed in claim 14, wherein a portion of the top board near a rear edge thereof protrudes upward to form a limiting block.

17. The SIM card connector as claimed in claim 14, wherein the top board of the shell defines locating slots at opposite sides thereof, opposite sides of the insulating panel define fixing holes, the cover has a top section and two side sections bending downward from opposite sides of the top section, each side section extends downward to form locking portions inserted in the locating slots of the shell and further inserted in the fixing holes of the insulating panel.

18. The SIM card connector as claimed in claim 17, wherein the locking portion has a pair of resilient arm adjacent and parallel with each other, the resilient arm protrudes outward to form a hook, the pair of the resilient arms is inserted in the locating slot of the shell and further inserted in the fixing hole of the insulating panel, the hooks clasp the bottom of the insulating panel.

19. The SIM card connector as claimed in claim 14, wherein the shell has an upper shell and a lower shell combined with each other, the top board is defined by the upper shell, the lower shell defines an accommodating hole for allowing the second contact portions of the terminals to pass therethrough to touch the printed circuit board.

20. The SIM card connector as claimed in claim 19, wherein the lower shell extends downward at edges thereof to form fences located on the printed circuit board, the top board of the upper shell extends downward at edges thereof to form enclosures buckling with the fences of the lower shell to locate the upper shell on the top of the lower shell.

* * * * *